US006505605B2

(12) United States Patent
Yamada et al.

(10) Patent No.: US 6,505,605 B2
(45) Date of Patent: Jan. 14, 2003

(54) CONTROL SYSTEM FOR AN INTERNAL COMBUSTION ENGINE AND METHOD CARRIED OUT BY THE SAME

(75) Inventors: Tatsunori Yamada, Aichi (JP); Yasushi Sakakura, Aichi (JP); Takahiro Suzuki, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 101 days.

(21) Appl. No.: 09/818,532

(22) Filed: Mar. 28, 2001

(65) Prior Publication Data

US 2001/0039941 A1 Nov. 15, 2001

(30) Foreign Application Priority Data

Mar. 29, 2000 (JP) ..... 2000-091569
Mar. 29, 2000 (JP) ..... 2000-091606

(51) Int. Cl.[7] ..... F02P 5/145
(52) U.S. Cl. ..... 123/406.14; 123/406.12
(58) Field of Search ..... 123/406.12, 406.14

(56) References Cited

U.S. PATENT DOCUMENTS 4,846,129 A * 7/1989 Noble ..... 123/406.14
5,493,227 A * 2/1996 Shimasaki et al. ..... 324/378
5,913,302 A * 6/1999 Ruman et al. ..... 123/609
6,006,156 A * 12/1999 Tozzi ..... 123/406.14

FOREIGN PATENT DOCUMENTS

| | | |
|---|---|---|
| JP | 61-155662 | 7/1986 |
| JP | 62-135668 | 6/1987 |
| JP | 5-26097 | 2/1993 |
| JP | 5-44624 | 2/1993 |
| JP | 2572494 | 10/1996 |
| JP | 10-306765 | 11/1998 |
| JP | 11-13620 | 1/1999 |
| JP | 11-30143 | 2/1999 |
| JP | 11-336649 | 12/1999 |

* cited by examiner

*Primary Examiner*—Erick Solis
(74) *Attorney, Agent, or Firm*—Sughrue Mion, PLLC

(57) ABSTRACT

A control system for an internal combustion engine is provided which comprises detecting means for detecting a discharge current flowing between electrodes of a spark plug when a high voltage for ignition is applied to the spark plug, judging means for judging whether or not the spark plug is fouled on the basis of the discharge current, and inhibiting means for inhibiting the progress of spark plug fouling when the spark plug is judged fouled. A method carried out by the control system is also provided.

31 Claims, 8 Drawing Sheets

CONTROL SYSTEM FOR AN INTERNAL COMBUSTION ENGINE AND METHOD CARRIED OUT BY THE SAME

BACKGROUND OF THE INVENTION

The present invention relates to a control system for an internal combustion engine which is capable of detecting a spark plug fouling in the engine and controlling an operating condition of the engine on the basis of the result of detection. The present invention further relates to a control system of the above described kind for use in a direct fuel injection engine. The present invention further relates to a method carried out by the control systems.

In an internal combustion engine, an air-fuel mixture is ignited by a spark of a spark plug provided to a cylinder. As shown in FIG. 4, a usual spark plug 17 includes a metal shell lid, an insulator 17*c* held inside the metal shell 17*d* and having an end portion protruding from the same, a center electrode 17*a* insulated by the insulator 17*c* from the metal shell 17*d* and having an end portion protruding from the insulator 17*c*, and a ground electrode 17*b* having an end portion attached to the metal shell 17*d* and the other end portion disposed opposite to the end portion of the center electrode 17*a* so as to provide a gap g therebetween. Such a spark plug 17 is constructed so that the insulation resistance between the center electrode 17*a* and the ground electrode 17*b* (i.e., the insulation resistance of the portion schematically represented by a voltmeter V in FIG. 4) is sufficiently large.

In an internal combustion engine, there can occur such a case in which when a rich mixture is introduced successively into a cylinder, the mixture is not combusted completely due to a factor such as incomplete atomization of fuel, and so-called carbon fouling (i.e., deposition of carbon or black soot on the surface of insulator 17*c*) is caused. When the amount of carbon adhered to the surface of the insulator 17*c* becomes large, that is, when the progress of carbon fouling becomes noticeable, the insulation resistance between the electrodes 17*a* and 17*b* of the spark plug 17 becomes smaller, thus possibly causing, when a high voltage for ignition is applied from an ignition coil (not shown) to the spark plug 17, a leakage current to flow through the deposition of carbon C so that a spark is not produced at the spark gap to cause a misfire.

Further, it is known a direct fuel injection internal combustion engine having a fuel injector whose injection nozzle is disposed inside a cylinder. The fuel injector injects fuel directly into the cylinder so as to form a rich air-fuel mixture adjacent a spark gap of a spark plug and a lean mixture around the rich mixture, i.e., so as to form a stratified mixture. The mixture is combusted so as to perform a so-called stratified combustion. Since the direct injection engine enables an ignition of a mixture which is considerably lean in an average air-fuel ratio of its entirety, it has an advantage of having a good fuel consumption. However, in the direct fuel injection engine, a rich mixture is introduced to a place adjacent the spark gap. The mixture has such a characteristic that it becomes harder to be atomized sufficiently as it becomes richer. Thus, the direct injection engine has a problem in that the fuel in a liquid state tends to be adhered to the surface of the insulator and not to be combusted completely but form carbon adhered onto the surface of the insulator, i.e., tends to cause carbon fouling of the spark plug.

Thus, it has been proposed a spark plug fouling detecting method as is disclosed in Japanese Patent Provisional Publication Nos. 11-13620 and 11-336649. The method utilizes a technique of detecting ion in terms of ion current, which ion is generated when an air-fuel mixture is ignited by a spark plug and combusted. A leakage current due to spark plug fouling is superimposed on an ion current. Thus, the behavior of current detected by an ion current detecting circuit at the time of generation of ion current (more specifically, the behavior of current after the focusing of ion current) varies depending upon a variation of leakage current. The leakage current varies depending upon the progress of spark plug fouling. The method disclosed in the above described publications is adapted to detect the progress of spark plug fouling by monitoring the behavior of the current detected by the ion current detecting circuit.

SUMMARY OF THE INVENTION

In the meantime, as shown in FIG. 4, in case the progress in adherence of carbon (black soot) C to the surface of the insulator 17*c* is at a stage prior to causing a short circuit between the electrodes 17*a* and 17*b* of the spark plug 17, a sufficient insulator resistance is kept between the electrodes 17*a* and 17*b* though a spark plug fouling has been caused. However, when a high voltage for ignition is applied from an ignition coil to the spark plug 17, there may occur such a case in which a spark is not produced across the spark gap g but a current flows through the carbon C adhered to the surface of the insulator 17*c* to cause the high voltage to jump across a gap between an end portion of the carbon layer C and the inner wall surface of the metal shell 17*d* to create a spark which is so-called "leak spark to inner shell bore". Although the mixture can be ignited if located adjacent a flame kernel produced by the leak spark, such a leak spark is more difficult to be exposed to the mixture as compared with a spark at the spark gap g, thus resulting in a tendency that the combustion efficiency attained by the leak spark is lower as compared with that attained by the spark at the spark gap g.

While the method disclosed in the above described publications is adapted to detect the progress or growth of spark plug fouling, detection of the progress is made on the basis of leakage current. Generally, leakage current is caused when the spark plug fouling progresses to such an extent as to cause a short circuit and the insulation resistance between the electrodes is lowered. Thus, the method can not detect spark plug fouling until the spark plug fouling progresses to such an extend as to cause a short circuit between the electrodes of the spark plug and is therefore in a condition of causing misfires in a high probability. However, the method cannot detect spark plug fouling in a stage prior to causing a short circuit between the electrodes, i.e., spark plug fouling in a condition of causing a leak spark to inner shell bore.

For this reason, if the above described method is used for detecting the spark plug fouling and controlling the operating condition of the engine so as to inhibit the progress of the spark plug fouling, it is made to start inhibiting of the progress of spark plug fouling after the spark plug fouling has been progressed to be capable of causing a misfire in a considerably high probability. However, if it is made to start inhibiting of the spark plug fouling after the spark plug fouling has been progressed to such an extent as to cause a misfire in a considerably high probability, occurrence of a misfire due to a spark plug fouling during operation of an internal combustion engine can not be prevented or inhibited sufficiently, thus causing a possibility of lowering the performance efficiency of the engine and incurring emission of unburned gases for badly affecting the environment.

It is accordingly an object of the present invention to provide a control system for an internal combustion engine which can detect a spark plug fouling at a stage prior to causing a misfire and inhibit the progress or further growth of the spark plug fouling for thereby preventing the performance efficiency of the engine from being lowered or deteriorated by the spark plug fouling.

It is a further object of the present invention to provide a control system of the foregoing character, which is used for a direct fuel injection type engine.

It is a still further object of the present invention to provide a method carried out by the control system of the foregoing character.

To achieve the above objects, there is provided according to an aspect of the present invention a control system for an internal combustion engine comprising detecting means for detecting a discharge current flowing between electrodes of a spark plug when a high voltage for ignition is applied to the spark plug, judging means for judging whether or not the spark plug is fouled on the basis of the discharge current, and inhibiting means for inhibiting the progress of spark plug fouling when the spark plug is judged fouled.

According to a further aspect of the present invention, there is provided a control system for a direct fuel injection internal combustion engine comprising detecting means for detecting a discharge current flowing between electrodes of a spark plug when a high voltage for ignition is applied to the spark plug, judgement means for judging whether or not the spark plug is fouled on the basis of the discharge current, and inhibiting means for varying at least a fuel injection timing at which fuel is injected into a cylinder and thereby inhibiting the progress of fouling of the spark plug when the spark plug is judged fouled.

According to a further aspect of the present invention, there is provided a method of controlling an internal combustion engine comprising detecting a discharge current flowing between electrodes of a spark plug when a high voltage for ignition is applied to the spark plug, judging whether or not the spark plug is fouled on the basis of the discharge current, and inhibiting the progress of fouling of the spark plug when the spark plug is Judged fouled.

DESCRIPTION OF THE PREFERRED EMBODIMENTS

Figure 1:
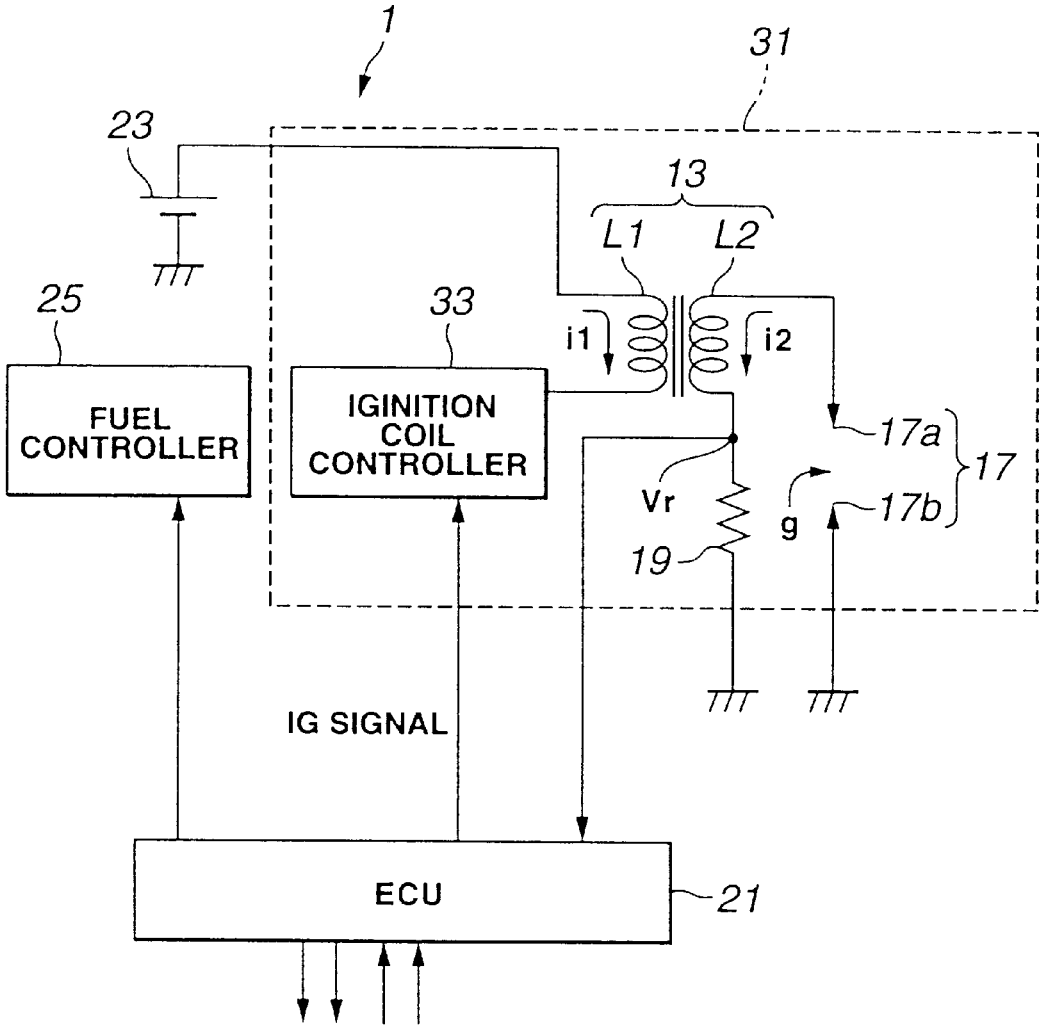
FIG. 1 is a circuit diagram of a control system for an internal combustion engine according to a first embodiment of the present invention.

Referring first to FIG. 1, a control system for an internal combustion engine according to an embodiment of the present invention is generally indicated by 1. The control system 1 includes an electronic control unit (ECU) 21 consisting of a microcomputer for calculating controlled variables of various control sections on the basis of an operating condition of an internal combustion engine and outputting instruction signals according to the calculated controlled variables to the control sections for thereby controlling the engine synthetically or collectively, a fuel control device or fuel controller 25 for supplying fuel for forming an air-fuel mixture in response to an instruction signal from the ECU 21, and an ignition control device 31 for producing a spark for igniting the mixture in response to an instruction signal from the ECU 21.

In the meantime, while the fuel controller 25 and the ignition control device 31 are provided to each cylinder when an associated internal combustion engine has a plurality of cylinders, only a portion thereof provided to one cylinder is shown in FIG. 1 for simplicity of illustration and ease of understanding.

The ignition control device 31 includes an ignition coil 13 consisting of a primary winding L1 connected to a power unit 23 and a secondary winding L2, a spark plug 17 provided to each cylinder of the engine and connected in series with the secondary winding L2 for producing a spark across a gap g between a center electrode 17*a* and a ground electrode 17*b*, a detection resistor 19 connected in series with a discharge current path constituted by the secondary winding L2 and the spark plug 17, and an ignition coil controller 33 responsive to a signal (IG signal) from the ECU 21 for controlling energizing and deenergizing of the primary winding L1 of the ignition coil 13 and thereby inducing a high voltage for ignition in the secondary winding L2.

The ignition coil controller 33 receives an IG signal from the ECU 21 so as to control energizing and deenergizing of the primary winding L1, for example, in such a manner not to allow current (primary current i1) to flow through the primary winding L1 when the IG signal is low in level (generally, of ground potential) but allow current to flow through the primary winding L1 when the IG signal is high in level (e.g., of 5 volts which is the voltage supplied from a constant-voltage power unit). In the meantime, the ignition coil controller 33 can be constituted by, for example, a switching device (e.g., power transistor) made up of a semiconductor device for carrying out supply and interruption of supply of primary current i1.

Thus, when an IG signal outputted by the ECU 21 becomes high in level, primary current i1 is caused to flow through the primary winding L1. In this instance, when the IG signal becomes low in level during the time the primary current i1 is flowing through the primary winding L1, the ignition coil controller 33 stops supplying or interrupts supply of the primary current i1 to the primary winding L1. When this is the case, the magnetic flux density in the ignition coil 13 varies rapidly and a high voltage for ignition which is an induced electromotive force is generated or induced in the secondary winding L2 of the ignition coil 13 and applied to the spark plug 17, thus causing a spark discharge to be generated between the electrodes 17*a* and 17*b* of the spark plug 17.

At the time of generation of a spark discharge, a discharge current (secondary current i2) flows through a discharge current path including the secondary winding L2 and the detection resistor 19. In this instance, there is generated between the opposite ends of the detection resistor 19 a detection voltage Vr which is determined depending upon the resistance value of the detection resistor 19 and the current value of the secondary current i2. In this connection, since the resistance value of the detection resistor 19 is a fixed value, the detection voltage Vr is proportional to the secondary current i2. The detection voltage Vr generated between the opposite ends of the detection resistor 19 is inputted to the ECU 21.

In the meantime, it is desirable that the resistance value of the detection resistor 19 is set so as to be within the range from 1Ω to 10 KΩ. By so setting the resistance value, a potential difference which is free from an influence of noise can be generated between the opposite ends of the detection resistor 19.

In order to confirm how the secondary current i2 varies depending upon a variation of spark plug fouling, measurement of the secondary current i2 was made with respect to various kinds of spark discharge, i.e., (a) a normal spark discharge and (b) an abnormal spark discharge at the time of spark plug fouling which is at the stage prior to causing a short between the electrodes of the spark plug. The result of measurement will be described hereinafter.

Figure 4:
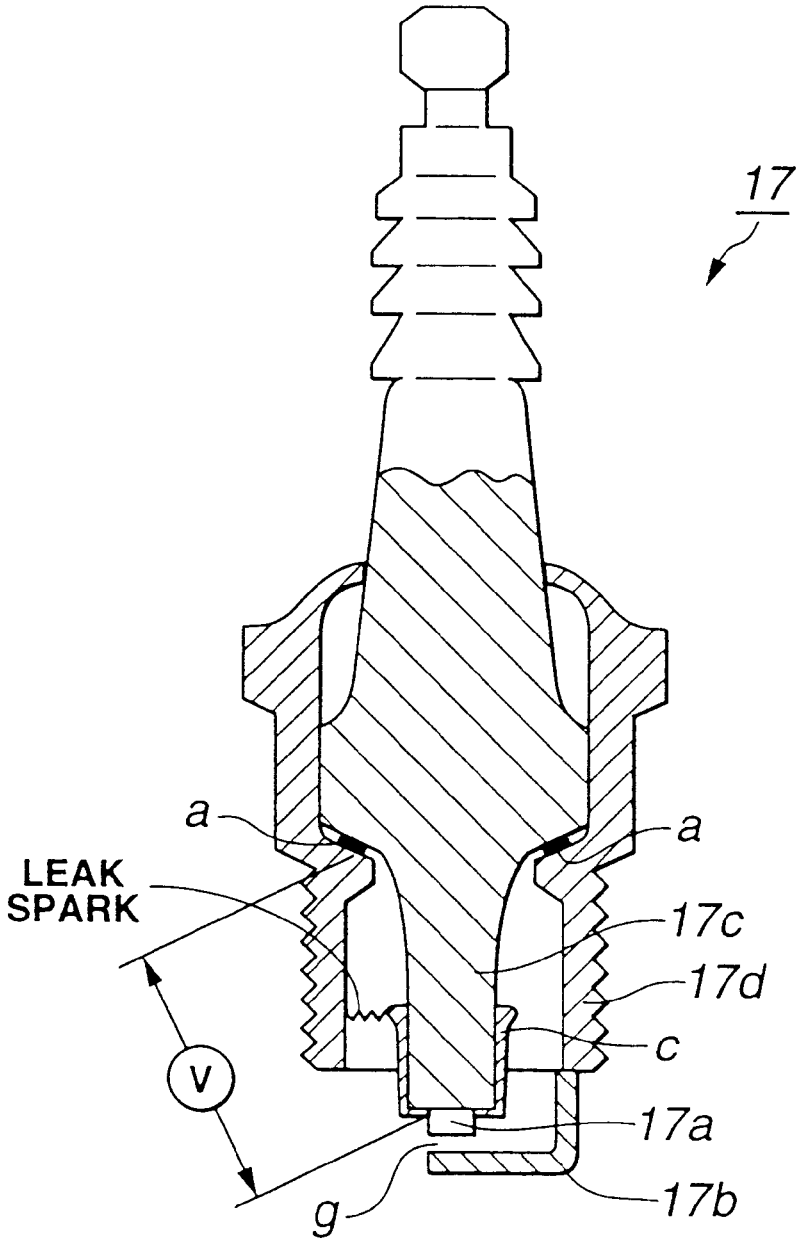
FIG. 4 is a schematic sectional view of a spark plug for illustration of "leak spark to inner shell bore"

In the meantime, the normal spark discharge is intended to indicate a spark discharge which is attained by a spark plug 17 in such a condition in which there is scarcely any carbon adhered to the surface of the insulator 17*c* holding therewithin the center electrode 17*a* and which is generated at a proper spark plug gap. The abnormal spark discharge at the time of spark plug fouling is intended to indicate a spark discharge which is attained by a spark plug in a fouled condition of allowing, as shown in FIG. 4, carbon C to be adhered to the surface of the insulator 17*c* so as to extend from an end portion on the center electrode 17*a* side to a portion adjacent a point "a" of contact between the insulator 17*c* and the inner wall face of the metal shell 17*d* having fixed thereto the ground electrode 17*b* (actually, both are joined by interposing therebetween a seat packing), i.e., a spark discharge generated between an end of the carbon C and the inner surface of the metal shell 17*d*, namely, so-called leak spark to inner shell bore.

Figure 5A:
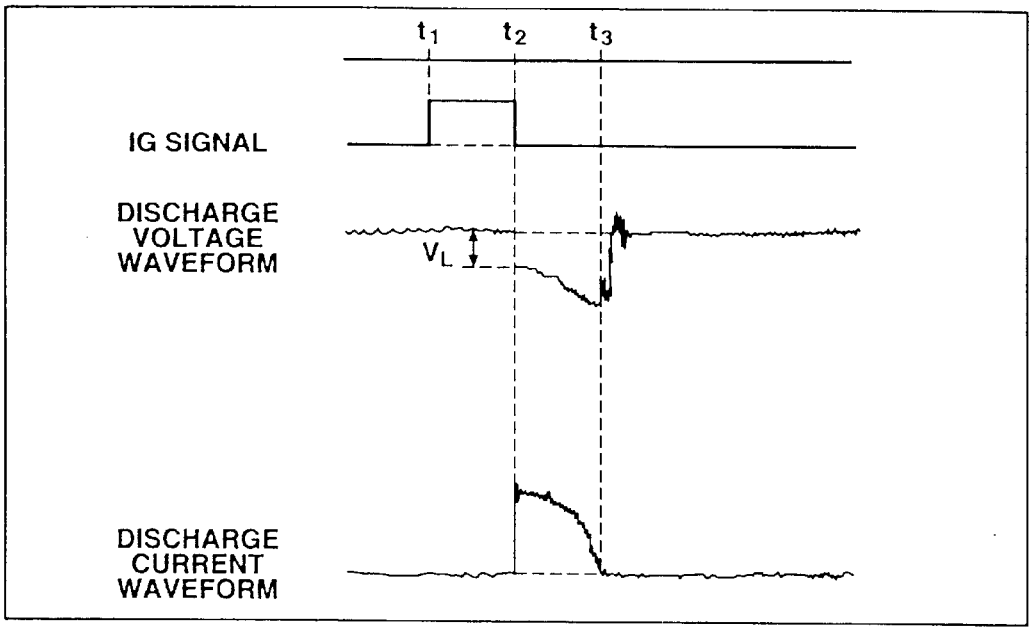
FIGS. 5A and 5B are time charts illustrating a normal spark discharge and an abnormal spark discharge at the time of a spark plug fouling which is at a stage prior to causing a short circuit between electrodes of a spark plug, respectively.
Figure 5B:
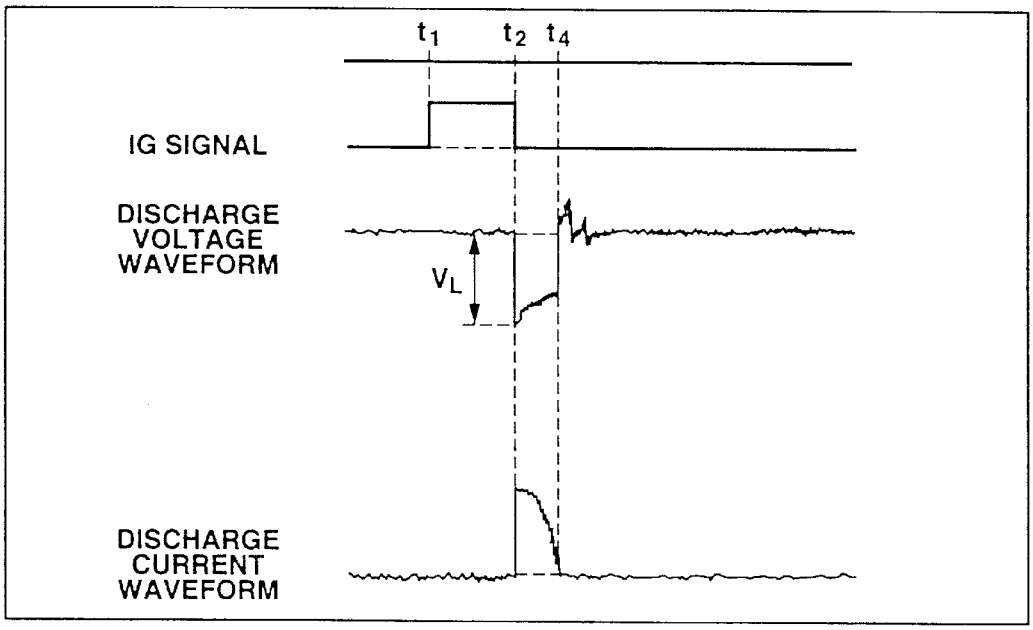

The time charts of FIGS. 5A and 5B show the result of measurement of the IG signal, the electric potential Vp at the center electrode 17*a* of the spark plug 17, and the electric potential Vr (secondary current i2) at a secondary winding L2 side connecting end of the detection resistor 19 in the circuit of FIG. 1. FIGS. 5A and 5B show the result of measurement of (a) a normal spark discharge and (b)an abnormal spark discharge at the time of spark plug fouling, respectively. Further, in FIGS. 5A and 5B, the electric potential Vp and the electric potential Vr are referred to as a discharge voltage waveform and a discharge current (secondary current i2) waveform, respectively.

Firstly, in FIG. 5A, at the time t1, the IG signal is varied from low to high in level, and the primary current i1 is supplied to the primary winding L1 of the ignition coil 13. Thereafter, at the time t2 after lapse of a preset energizing time, the IG signal is varied from high to low in level to interrupt supply of the primary current i1 to the primary winding L1 of the ignition coil 13. When this is the case, a high voltage for ignition is induced in the secondary winding L2 and a negative high voltage is applied to the center electrode 17*a* of the spark plug 17. By this, the electric potential Vp at the center electrode 17*a* is abruptly lowered to show a peak value, and a spark discharge is generated between the electrodes 17*a* and 17*b* of the spark plug 17 while at the same time the discharge current (secondary current i2) starts flowing.

The potential difference between the discharge voltage (electric potential Vp) immediately after a spark discharge and the ground level (0 volt) decreases abruptly from the peak value to the potential difference $V_L$, and thereafter the potential difference varies so as to increase gradually. When this is the case, the discharge current (secondary current i2) decreases gradually and becomes zero (0 A) to finish the spark discharge at the time t3.

Then, in FIG. 5B, a change from the time t1 to the time t2 is the same as that in FIG. 5A. The potential difference between the discharge voltage (potential Vp) immediately after spark discharge and the ground level (0 volt) decreases abruptly from the peak value to the potential difference $V_L$, and thereafter the potential difference decreases gradually. In this instance, the potential difference $V_L$ in FIG. 5B is larger than the potential difference $V_L$ in FIG. 5A. The discharge current (secondary current i2) decreases gradually and becomes zero (0 A) to finish the spark discharge at the time t4 earlier than the time t3.

From comparison of the foregoing results with respect to the duration of spark discharge (i.e., a period of time in which spark discharge continues), it will be understood that the normal spark discharge (a) is longer in duration than the abnormal spark discharge (b) at the time of spark plug fouling which is at the stage prior to causing a short between the electrodes of the spark plug. Further, from comparison of the area which is calculated from the waveform of the discharge current (secondary current i2) in FIGS. 5A and 5B, i.e., the integration value of the discharge current, it will be understood that the normal discharge (a) is larger in the integration value of discharge current than the abnormal spark discharge (b) at the time of spark plug fouling at the stage prior to causing a short between the electrodes of the spark plug.

Accordingly, by the use of the duration of spark discharge or the integration value of discharge current, it becomes possible to determined whether the spark discharge produced at that moment is normal or abnormal (i.e., leak spark). Further, detection of the leak spark enables to detect the spark plug fouling at the stage prior to causing a short between the electrodes of the spark plug. In the meantime, a process for making a judgment on spark plug fouling on the basis of discharge current is executed by the ECU 21 and will be described in detail hereinafter.

The fuel controller 25 is, for example, a fuel injector provided to an intake pipe of the engine for injecting fuel for forming an air-fuel mixture into the intake pipe.

The fuel controller 25 receives a fuel instruction signal outputted by the ECU 21 and is adapted, for example, not to inject fuel when the fuel instruction signal is low in level (generally of ground potential) and to inject fuel when the fuel instruction signal is high in level (e.g., of 5 volts which is a supply voltage of a constant-voltage power unit). In the meantime, the fuel controller 25 is constructed so that when it injects fuel, a fuel supply quantity per unit time is constant, i.e., a quantity of fuel injected per unit time is constant. Thus, the longer the time during which the fuel injection signal is maintained high in level, the larger the quantity of fuel supplied to the intake pipe.

Accordingly, the fuel controller 25 starts supply of fuel when the ECU 21 varies a fuel instruction signal level to high and stops supply of fuel when the ECU 21 varies the fuel instruction signal level to low. The time at which the fuel instruction signal level varies from low to high is the fuel injection timing, and the duration time during which the fuel injection signal is maintained high in level is proportional to the fuel supply quantity.

The processes executed by the ECU 21 will be described.

The ECU 21 is provided for controlling the ignition timing, fuel injection quantity, idling speed, etc. collectively, and performs, other than the fouling inhibiting process which will be described hereinlater, various control processes such as an ignition control process for controlling a spark discharge generated by a spark plug at an ignition timing, and an operation condition detecting process for detecting operating conditions at various portions of an engine such as an intake air quantity (intake pipe pressure), engine speed, throttle opening, coolant temperature, etc.

Firstly, an ignition control process will be described. In the meantime, after the engine is started, the ignition control process is performed once per each combustion cycle in which the engine performs intake, compression, combustion and exhaust, on the basis of a signal from, for example, a crank angle sensor which detects a rotational angle (i.e., crank angle) of the engine.

When the ignition control process is started in response to start of the engine, it is first made a judgment on the condition of a fouling detection flag E. In the meantime, the condition of the fouling detection flag E is determined in the fouling inhibiting process which will be described later, and the fouling detection flag E is brought into a set condition when the spark plug is judged fouled and into a reset condition when the spark plug is judged not fouled.

In this instance, when the fouling detection flag E is in the set condition, an operating condition of the engine which is detected by an operating condition detecting process which is executed separately, is read, and an ignition timing suited for the operating condition of the engine is calculated on the basis of the read operating condition and by using a map or an expression and determined as an ignition timing for a combustion cycle of this time. In the meantime, it is desirable that the map or expression for calculating the ignition timing is adapted to calculate the ignition timing suited to the operating condition of the engine on the basis of parameters of engine operating conditions such as engine speed and engine load.

Further, when the fouling detection flag E is in the set condition, the ignition timing is not updated but the following process is executed by using an ignition timing which is determined by the fouling inhibiting process which will be described later.

Then, on the basis of the ignition timing which has been finally determined, the IG signal is varied to become high in level at the time which is earlier by a predetermined time than the finally determined ignition timing for thereby operating the ignition coil controller 33 and starting supply of the primary current i1 to the primary winding L1. In this instance, the predetermined time is a primary current supply time (i.e. a time during which the primary winding L1 is supplied with the primary current i1 and energized). The primary current supply time is set so that a sufficient flux can be stored in the ignition coil for enabling a high voltage for ignition to generate such a spark that can assuredly ignite a mixture even under an engine operating condition where the ignitability of the mixture is not good. By this, the spark discharge duration time from start to finish of a spark discharge can be sufficiently long and it becomes possible to assist the progress of the flame kernel and thereby combust the mixture assuredly even under an engine operating condition such as a low load and low speed engine operating condition where the ignitability of the mixture is not good.

Thereafter, in the ignition control process, at the ignition timing which is the time when the primary current supply time has elapsed since the IG signal had been varied to become high in level, the IG signal is varied to become low in level to operate the ignition coil controller 33. By this, the supply of the primary current i1 is interrupted rapidly and a high voltage for ignition which is an induced electromotive force is generated in the secondary winding L2 for thereby causing the spark plug 17 to produce a spark.

Accordingly, the ignition control process controls the IG signal in such a manner that a spark discharge is generated at the ignition timing which is determined in accordance with the operating condition of the engine, whereby a spark discharge is generated across the electrodes of the spark plug 17 at the ignition timing suited to the operating condition of the engine to combust the mixture.

Then, the fuel control process will be described. In the meantime, after the engine is started, the fuel control process is performed once per each combustion cycle in which the engine performs intake, compression, combustion and exhaust, on the basis of a signal from, for example, a crank angle sensor which detects a rotational angle (i.e., crank angle) of the engine.

When the fuel control process is started in response to start of the engine, a judgement on the condition of the fouling detection flag E is first made. In the meantime, the fouling detection flag E is the same as that used in the aforementioned ignition control process and its condition is determined in the fouling inhibiting process which will be described later.

In this instance, when the fouling detection flag E is in the reset condition, an operating condition of the engine which is detected by the operating condition detecting process which is executed separately, is read, and a fuel supply quantity for producing a mixture having an air-fuel ratio suited to the operating condition of the engine is calculated on the basis of the read operating condition and by using a map or an expression and determined as a fuel supply quantity for a combustion cycle of this time. In the meantime, it is desirable that the map or expression for calculating the fuel supply quantity is adapted to calculate the fuel supply quantity suited to the operating condition of the engine on the basis of parameters of engine operating conditions such as engine speed and engine load.

Further, when the fouling detection flag E is in the set condition, the fuel supply quantity is not updated but the following process is executed by using a fuel supply quantity which is determined by the fouling inhibiting process which will be described later.

Thereafter, when it comes a preset fuel injection timing, the fuel instruction signal is varied to become high in level and thereby the fuel controller 25 is operated to start injection of ,fuel into an intake pipe of the engine. Then, after lapse of a time necessary for carrying out supply of fuel of the fuel supply quantity which is finally determined (namely, the duration time during which the fuel instruction signal is maintained high in level) since the fuel instruction signal is varied to become high in level, the fuel instruction signal is varied to become low in level and thereby the operation of the fuel controller 25 is stopped to stop injection of fuel.

Accordingly, the fuel control process controls the fuel instruction signal in such a manner that fuel of a fuel supply quantity which is determined in accordance with the operating condition of the engine is supplied to the intake pipe, whereby the fuel controller 25 is operated to supply fuel into the intake pipe and thereby produce a mixture of an air-fuel ratio suited to the operating condition of the engine.

Then, a leak spark judging process executed by the ECU 21 will be described with reference to the flowchart of FIG. 2. In the meantime, the judging process is executed once per each combustion cycle in which the engine performs intake, compression, combustion and exhaust, on the basis of a signal from, for example, a crank angle sensor which detects a rotational angle (i.e., crank angle) of the engine.

The leak spark judging process is started at the same time when it becomes the ignition timing. Firstly, in step S210, a discharge current integration value Ii is calculated by integrating a discharge current detected by the detection resistor 19 at the time of generation of spark discharge. In this instance, as the method of calculating the discharge current integration value Ii, is used a method of adding or summing up a discharge current at regular intervals or at intervals of a predetermined crank angle. In the meantime, the calculating method can be such a method wherein, for example, a current of a value proportional to the discharge current is supplied to a capacitor and a discharge current integration value is calculated on the basis of a charge stored in the capacitor.

In step S220, it is judged whether or not the discharge current integration value Ii calculated in step S210 is smaller than a value obtained by multiplying an average current integration value Ib by a judgement coefficient K. When the judgement is Yes, the program proceeds to step S230. When the judgement is No, the program proceeds to step S240.

In this instance, the average current integration value Ib is an average of the integration value of the discharge current flowing through the discharge current path when a spark discharge is generated across the gap g of the spark plug (i.e., at the time of normal spark discharge). In the meantime, the average current integration value Ib has been updated in step S240 which will be described later and is updated in response to a secular variation of the engine.

Further, the resistance value of the discharge current path at the time of leak spark is larger as compared with that at the time of normal discharge since the discharge current at the time of leak spark which is caused by adherence of carbon flows through a discharge current path including a carbon layer adhered to the surface of the insulator and having a relatively large resistance. For this reason, the discharge current flowing between the electrodes of the spark plug at the time of leak spark is smaller than that at the time of normal spark discharge. Accordingly, the judgement coefficient K is previously set to a value that forms a border between the discharge current integration value at the time of normal spark discharge and the discharge current integration value at the time of leak spark, e.g., 0.7 when the discharge current integration value at the time of normal spark discharge is assumed to be 1.

Accordingly, in step S220, occurrence of a leak spark is detected by judging whether or not the discharge current integration value Ii calculated in step S210 is smaller than the value obtained by multiplying the average current integration value Ib by the judgement coefficient K.

When the judgement in step S220 is Yes, the program proceeds to step S230. In step S230, it is judged that the spark discharge at this time combustion cycle is an abnormal spark discharge(leak spark).

Further, when the judgement in step S220 is No, the program proceeds to step S240. In step S240, it is judged that the spark discharge at this time combustion cycle is a normal spark discharge, and the average current integration value Ib is updated.

In this instance, the update of the average current integration value Ib in step S240 is performed by, for example, the method of moving averages, i.e., by substituting the average of the discharge current integration values Ii, which are for a plurality of latest combustion cycles (e.g., of latest ten combustion cycles) where the spark discharge has been judged normal and which include the average integration value Ii calculated in step S210 in the present combustion cycle, for the average current integration value Ib. By this, the latest discharge current integration values Ii which have been judged to be representative of a normal spark discharge can be reflected in the average current integration value Ib, thus making it possible to update the average current integration value Ib in accordance with a variation of the discharge current caused by a secular variation of the engine. In the meantime, the calculation of the average of the discharge current integration value Ii is not limited to the method of moving average but can be made by the method of exponential average.

When the steps S230 and S240 are executed, the leak spark judgement process is finished.

In the meantime, the average current integration value Ib is stored in an unvolatile memory at any time when it is updated at step S240. Thus, in the first leak spark judging process which is executed immediately after start of the engine, the average current integration value Ib stored at the end of the last operation of the engine is read from the memory and used in step S220 of the first leak spark judging process.

Further, the discharge current detection values Ii for a plurality of latest combustion cycles, on the basis of which a decisions of normal discharge was made, are also stored in, for example, an unvolatile memory at all times. In the several leak spark judging processes after start of the engine, the discharge current integration values Ii for a plurality of latest combustion cycles stored at the end of the last operation of the engine are read from the memory and used for updating the average current integration value Ib. Namely, in the several leak spark judging processes after start of the engine, an average of the discharge current integration values Ii at the last operation of the engine and the discharge current integration values Ii at this time operation of the engine are calculated and used for updating the average current integration value Ib. Thus, by updating the average current integration value Ib by using the discharge current integration values Ii stored at the last operation of the engine, the average current integration value Ib is updated in accordance with a variation of discharge current resulting from a secular variation of the engine.

The result of judgement on the spark discharge by the leak spark judging process is used, for example, for a leak spark frequency calculating process executed separately by the ECU 21 for calculating a leak spark frequency F. The leak spark frequency calculating process is started after lapse of a predetermined time (e.g., a time necessary for the coolant temperature to rise beyond 50° C.) after start of the engine and calculates a leak spark occurrence rate(%) in all the latest combustion cycles (e.g., 100 cycles) as a leak spark frequency F.

Figure 3:
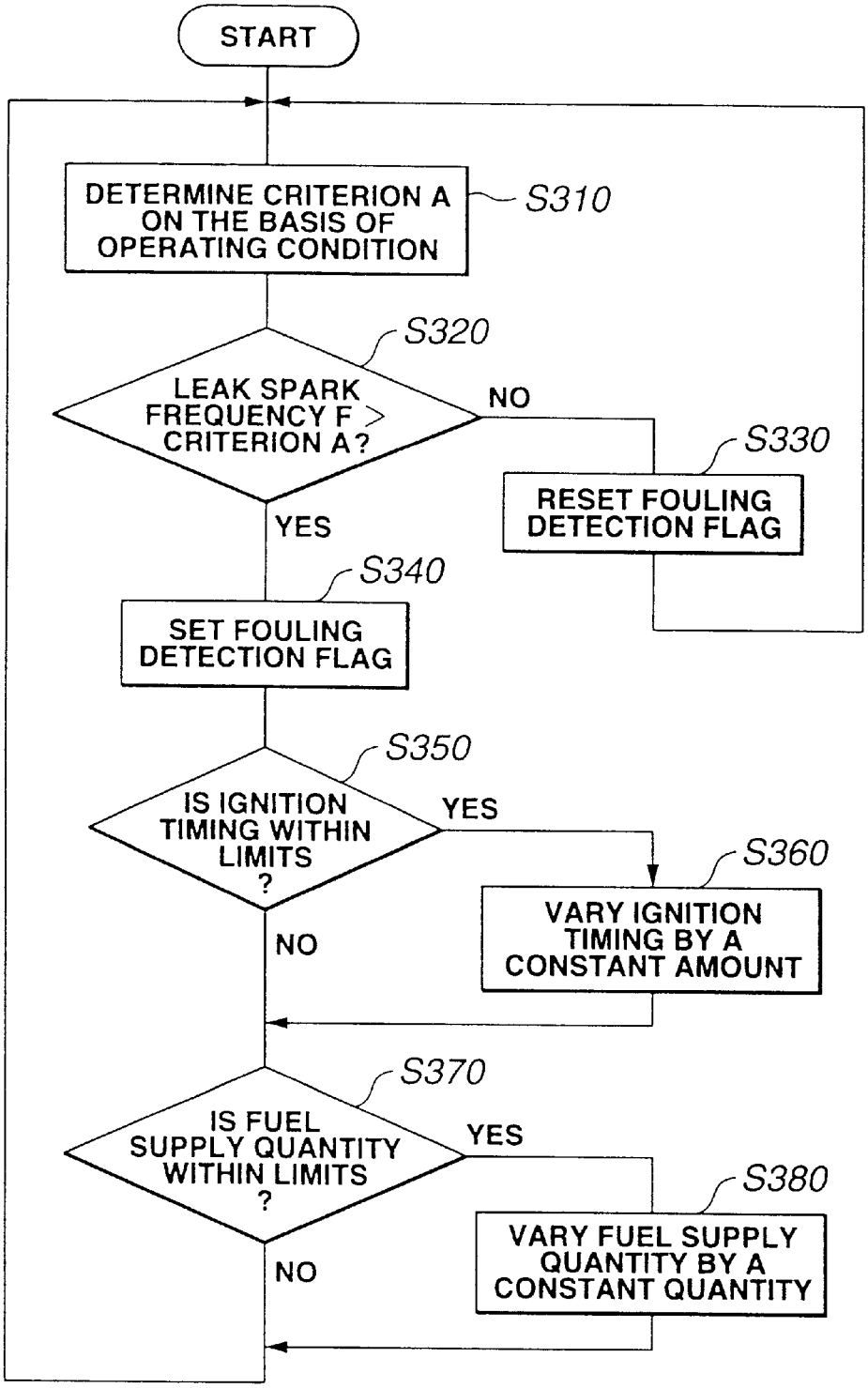
FIG. 3 is a flow chart of a fouling inhibiting process executed by an ECU 21 of the control system of FIG. 1.

Then, the fouling inhibiting process executed by the ECU 21 will be described with reference to the flowchart of FIG. 3. In the meantime, the fouling inhibiting process is started after lapse of a predetermined time (e.g., a time necessary for the coolant temperature to rise beyond 50° C.) after start of the engine.

When the fouling inhibiting process is started, it is first read in step S310 a fouling judgement criterion A for making a judgement on whether or not the leak spark frequency F exceeds a range within which a stable operation of the engine can be obtained, in accordance with the operating condition of the engine and by using a map or an expression the parameters of which are operating conditions of the engine. In the meantime, the map or expression is determined on the basis of the result of measurement which is conducted previously, and the judgement criterion A according to the operating condition of the engine is calculated by using the operating conditions of the engine as parameters.

Then, in step S320, it is judged whether or not the leak spark frequency F of the engine in operation is larger than the judgement criterion A read in step S310. When the judgement is Yes, the program proceeds to step S340. When the judgement is No, the program proceeds to step S330. Namely, in step S320, it is judged on the basis of the leak spark frequency F whether or not the spark plug fouling is in a condition of enabling the engine to operate stably. In other words, it is judged in step S320 whether or not a process for inhibiting the progress of spark plug fouling is to be performed or not. In the meantime, the leak spark frequency F is calculated by the above described leak spark frequency calculating process and represents the latest leak spark occurrence rate (%) of the engine.

When the judgement in step S320 is No, the program proceeds to step S330. In step S330, the fouling detection flag E is brought into the reset condition. By so setting the fouling detection flag E, the ignition timing and the fuel supply quantity are set by the above described ignition timing control process and the fuel control process so as to be suited to the operating condition of the engine at normal driving where spark plug fouling is not caused. When step S330 is executed, the program returns to step S310.

Further, when the judgement in step S320 is Yes, the program proceeds to step S340. In step S340, the fouling detection flag E is brought into a set condition. By bringing the fouling detection flag E into the set condition, the ignition timing and the fuel supply quantity are not determined by the above described ignition timing control process and the fuel control process but by this fouling inhibiting process. When step S340 is executed, the program proceeds to step S350.

Then, in step S350, it is judged whether or not the ignition timing having been set at this moment is within the limits which are previously set so as to enable the engine to operate stably. When the judgement in step S350 is Yes, the program proceeds to step S360. When the judgement in step S350 is No, the program proceeds to step S370. In the meantime, the ignition timing at this moment corresponds to the ignition timing of the last combustion cycle.

In step S360, the ignition timing is varied by a constant amount for inhibiting the progress of spark plug fouling. In this instance, a variation of a constant amount of the ignition timing is attained by, for example, calculating an indicated mean effective pressure every each combustion cycle, calculating a variation of the indicated mean effective pressure caused by advancing the ignition timing by a constant amount and varying the ignition timing in a way as to cause the indicated mean effective pressure to become larger. Namely, for example, in case the indicated mean effective pressure in the combustion cycle after the ignition timing is advanced becomes larger than that before the ignition timing is advanced, the ignition timing in the next combustion cycle is further advanced. On the contrary, in case the indicated mean effective pressure in the combustion cycle after the ignition timing is advanced becomes smaller than that before the ignition timing is advanced, the ignition timing in the next combustion cycle is retarded.

In case the ignition timing is actually varied by using the indicated mean effective pressure, the indicated mean effective pressures in the last combustion cycle is compared with that in the combustion cycle before the last. When the indicated mean effective pressure in the last combustion cycle is larger than that in the combustion cycle before the last, the ignition timing which is attained by changing the ignition timing in the last combustion cycle in the direction in which the ignition timing is varied from the last combustion cycle to the combustion cycle before the last is determined as the ignition timing at this time. On the contrary, when the indicated mean effective pressure in the last combustion cycle is smaller than that in the combustion cycle before the last, the ignition timing which is attained by varying the ignition timing in the last combustion cycle in the direction opposite to that in which the ignition timing is varied from the combustion cycle before the last to the last combustion cycle is determined as the ignition timing at this time.

Control of the ignition timing so as to increase the indicated mean effective pressure in the above described manner improves the combustion condition of the mixture, and therefore it becomes possible to combust fuel completely and inhibit production of carbon. Thus, by changing the ignition timing for thereby combusting fuel completely, the progress of spark plug fouling can be inhibited and the carbon adhered to the surface of the insulator will be soon burnt off by the self-cleaning action of the spark plug.

When the judgement in step S350 is No or step S360 is executed, the program proceeds to step S370. In step S370, it is judged whether or not the fuel supply quantity having been set at this moment is within the limits which are determined so as to enable the engine to operate stably. When the judgement in step S370 is Yes, the program proceeds to step S380. When the judgement in step S370 is No, the program proceeds to step S310. In the meantime, the fuel supply quantity at this moment corresponds to that in the last combustion cycle.

When the judgement in step S370 is Yes, the program proceeds to step S380. In step S380, the fuel supply quantity is varied by a constant amount for inhibiting the progress of spark plug fouling. In this instance, it is desirable to decrease the fuel supply quantity for its variation. Namely, by decreasing the fuel supply quantity and thereby making the air-fuel mixture higher (i.e., leaner), atomization of the fuel is accelerated and the fuel is combusted completely, thus making it possible to inhibit production of carbon resulting from fuel in a liquid state. Further, by decreasing the fuel supply quantity and thereby combusting the fuel completely, it becomes possible to inhibit the progress of spark plug fouling and then make the carbon adhered to the surface of the insulator be burnt off soon by the self-cleaning action of the spark plug for thereby cleaning the spark plug.

When the step S380 is executed, the program returns to step S310.

In this manner, by executing the steps from S310 to S380 repeatedly, the fouling inhibiting process is performed.

As having been described as above, in the fouling inhibiting process, when it is judged that there is not any fouling (i.e., when the judgement in step S320 is No), the fouling detection flag E is reset (S320) for making the ignition timing and the fuel supply quantity be respectively determined by the injection control process and the fuel control process on the basis of the operating condition of the engine. For this reason, when it is judged that there is not any fouling, the engine can be operated by the ignition timing and the fuel supply quantity (air-fuel ratio) which are suited to the operating condition of the engine at normal driving.

Further, when it is judged that there is some fouling (i.e., when the judgement in step S320 is Yes), the fouling detection flag E is brought into a set condition (S340) for making the ignition timing and the fuel supply quantity be determined not by the injection control process and the fuel control process but by this fouling inhibiting process. In this fouling inhibiting process, the ignition timing and the fuel supply quantity which are set last in the ignition control process and the fuel control process (i.e., the ignition timing and the fuel supply quantity which are determined immediately before it is judged that there is some fouling) are determined as initial values and are varied by a constant amount so as to inhibit the progress of fouling, respectively. Further, once the fouling is detected, the ignition timing and the fuel supply quantity are respectively varied by a constant amount repeatedly until the carbon adhered to the surface of the insulator is burnt off by the self-cleaning action of the spark plug. For this reason, by variations or control of the ignition timing and the fuel supply quantity, the operating condition of the engine is brought into a condition of allowing the spark plug to exhibit the self-cleaning action more efficiently, thus making it possible to inhibit the progress of fouling and eliminate or remove the fouling effectively.

However, if the ignition timing and the fuel supply quantity are varied unlimitedly, there is caused a possibility that the engine cannot operate stably due to knocking, etc. or the fuel is consumed wastefully. Thus, the ignition timing and the fuel supply quantity are respectively judged in steps S350 and S370 as to whether or not they are within the limits that enable the engine to operate properly, and then the ignition timing and the fuel supply quantity are varied by a constant amount, respectively.

When it is judged that there is not any fouling (i.e., when the judgement in step S320 is No), the fouling detection flag E is brought into a reset condition (S330) so that the ignition timing and the fuel supply quantity are respectively set by the ignition control process and the fuel control process and controlled so as to be suited to the operating condition of the engine at normal driving.

As having been described above, in the internal combustion engine control system of this embodiment, a spark plug fouling is detected on the basis of discharge current before it causes a misfire. When a spark plug fouling is detected, the engine is controlled to vary the ignition timing and the fuel supply quantity so as to inhibit the progress of the fouling.

While in the leak spark detection process in this embodiment the leak spark is detected by using the integration value of discharge current, this is not for the purpose of limitation but the leak spark can also be detected as follows. Namely, it is first calculated a current detection time during which the current value of discharge current at the period of generation of spark discharge is larger than a predetermined detection criterion. The calculated current detection time is regarded as a spark discharge duration time. On the basis of the spark discharge duration time, the leak spark can be detected. Namely, it is judged that a leak spark is caused when the current detection time is smaller than a detection time criterion which draws a distinction between a normal spark and a leak spark.

Figure 6:
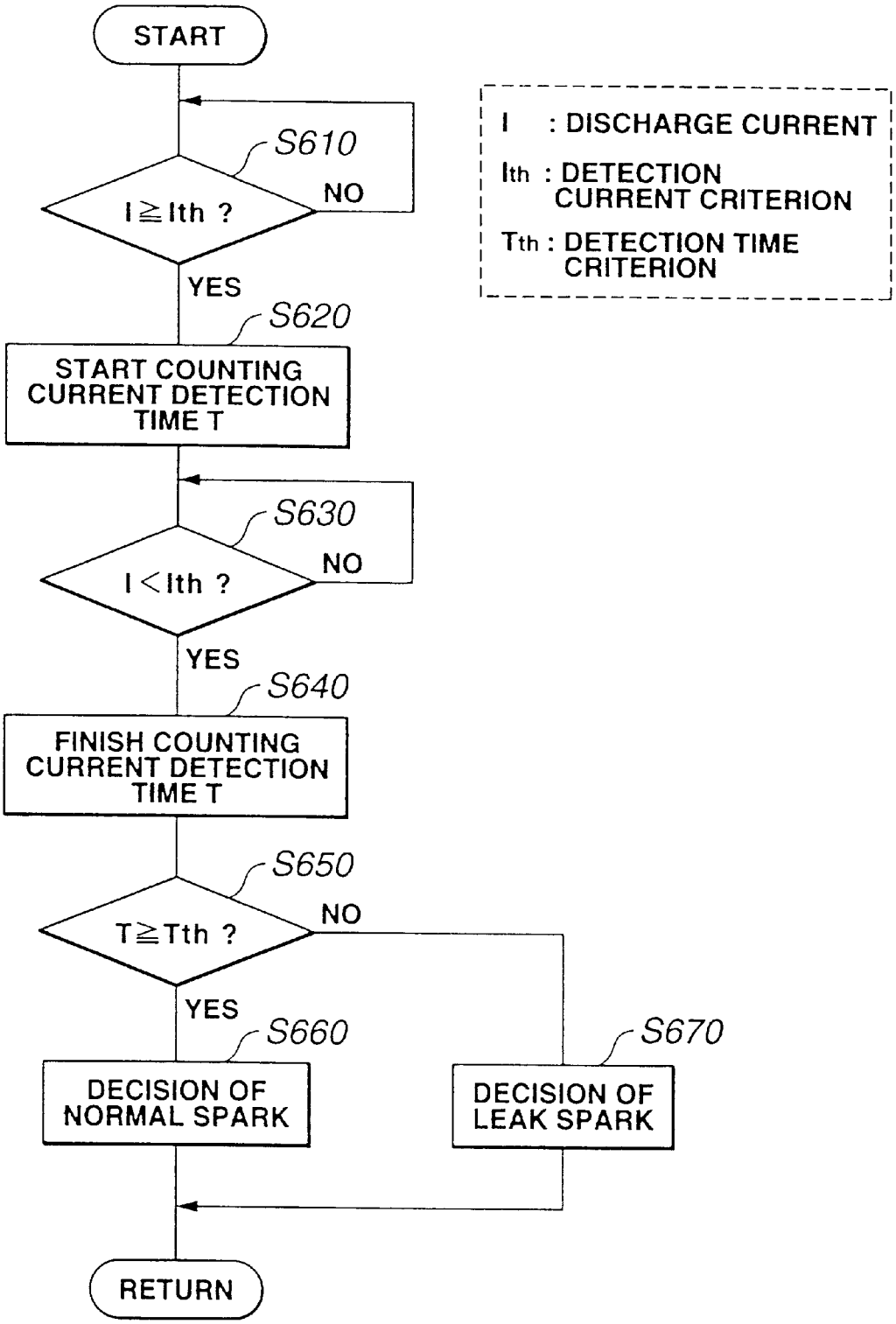
FIG. 6 is a flow chart of a judging process using a current detection time according a modification of the present invention, which is executed by the ECU 21 in the control system of FIG. 1.

FIG. 6 shows a modification of the leak spark judging process using a current detection time.

The leak spark judging process shown in FIG. 6 is started at the same time the ignition timing comes. Firstly, in step S610, it is judged whether or not the discharge current I detected by the potential Vr and the detection resistor 19 is larger than a predetermined reference detection current value Ith. When the judgement is Yes, the program proceeds to step S620. When the judgement is No, the step S610 is repeated.

When the detected discharge current I becomes equal to or larger than the detection current reference value Ith, the judgement in step S610 becomes Yes and the program proceeds to step S620. In step S620, the time at this moment is stored and it is started to count the current detection time T of the discharge current.

In the following step S630, it is judged whether or not the discharge current I is smaller than the detection current reference value Ith. When the judgement in step S630 is Yes, the program proceeds to step S640. In step S640, by subtracting the time stored in step S620 from the time at this moment, the current detection time T of the discharge current is calculated and its counting is finished.

In the subsequent step S650, it is judged whether or not the current detection time T of discharge current calculated in step S640 is equal to or larger than the detection time criterion Tth which is previously set so as to make a distinction between a normal spark and a leak spark. When the judgement is Yes, the program proceeds to step S660. When the judgement is No, the program proceeds to step S670.

In step S660, the spark discharge at this time combustion cycle is judged to be a normal spark. Further, in step S670, the spark discharge at this time combustion cycle is judged to be a leak spark.

When the step S660 or S670 is executed, the leak spark judging process is finished.

In this manner, the leak spark judging process shown in FIG. 6 makes a judgement on a normal spark and a leak spark by using a current detection time. The result of judgement on spark discharge by the leak spark judging process shown in FIG. 6 is used for the leak spark frequency calculating process, etc. similarly to the previous embodiment, i.e., the leak spark judging process shown in FIG. 2.

Figure 2:
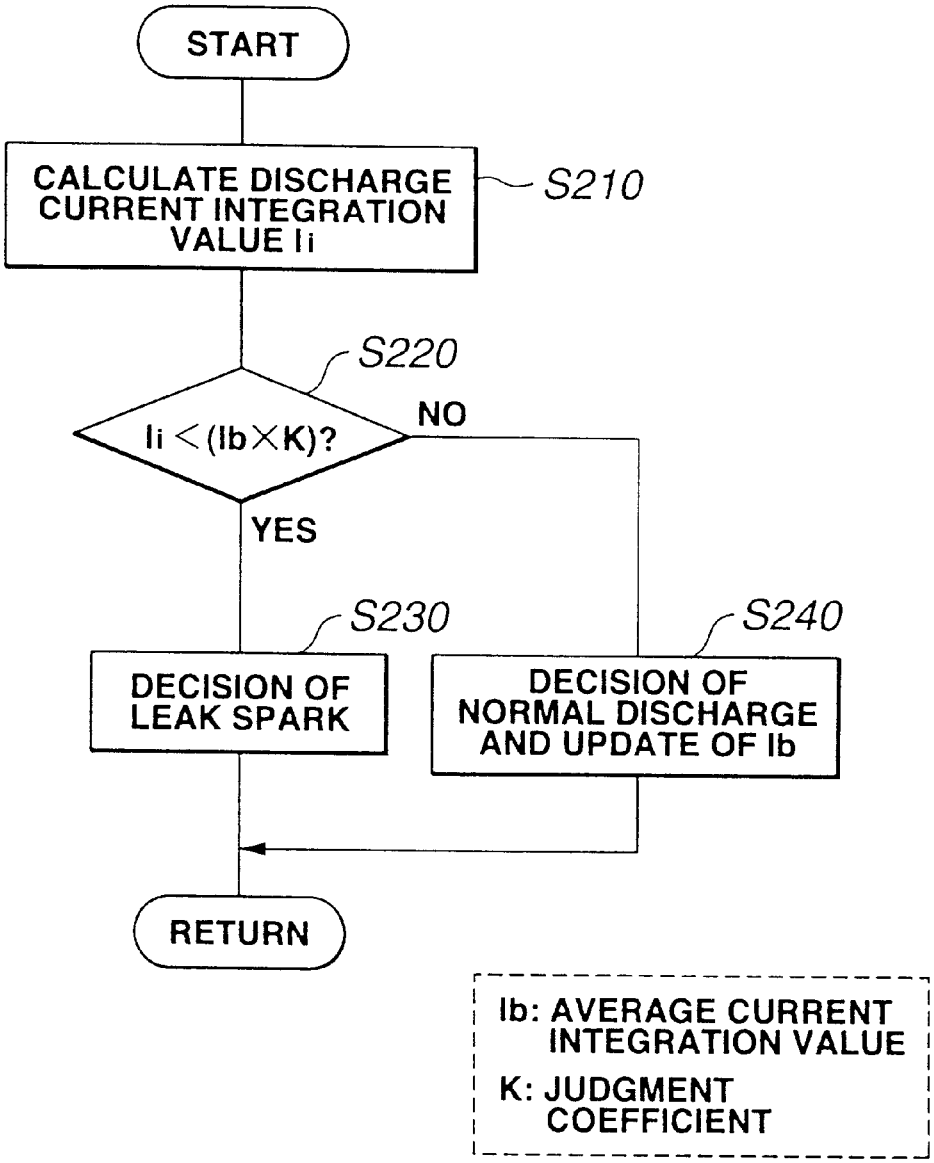
FIG. 2 is a flow chart of a judging process executed by an ECU 21 of the control system of FIG. 1.

The judgement coefficient K used in the leak spark judging process shown in FIG. 2 is not necessarily a fixed value but can be determined in accordance with the operating condition of the engine by using a map or an expression. By this, it becomes possible to make a distinction between a normal spark and a leak spark more accurately by the use of a judgement coefficient K which is suited to the operating condition of the engine.

Further, the leak spark judging process is not necessarily executed once per each combustion cycle but can be executed once per several combustion cycles. By this, the processing load on the ECU can be lightened.

Further, the limits of the ignition timing and the limits of the fuel supply quantity are not necessarily predetermined fixed values but can be determined according to the operating condition of the engine by using a map or an expression. By this, the ignition timing and the fuel supply quantity can be set within the limits that are suited to the operating condition of the engine.

Further, the controlled variables of the engine to be varied upon detection of fouling are not necessarily two, i.e., the ignition timing and the fuel supply quantity but can be one, i.e., the ignition timing or the fuel supply quantity. Namely, for example, the ignition timing is first varied and the engine is operated under a condition of a varied ignition timing. In case the progress of fouling cannot be inhibited even when the ignition timing is varied to the limits, the fuel supply quantity is then varied. In the meantime, in this instance, the fuel supply quantity can be varied first and then the ignition timing. Further, the control system can be constructed so as to vary only one control ed variable in case of an internal combustion engine wherein the progress of fouling can be inhibited by varying only one controlled variable.

In this manner, only one kind of controlled variable is varied in one combustion cycle. By this, it becomes possible to reduce the process to be executed in each combustion cycle, and therefore an increase in the load on the ECU at the time of executing the process for inhibiting the progress of fouling can be minimized.

Further, in an internal combustion engine having a plurality of cylinders, the process of inhibiting the progress of fouling for each cylinder can be executed separately. By this, it becomes possible to assuredly inhibit the process of fouling in a cylinder or cylinders where spark plug fouling is caused while attaining combustion of the mixture in a cylinder or cylinders where spark plug fouling is not caused, on the basis of controlled variables which are suited to normal driving.

The control system 1 which is modified for use in a direct fuel injection engine according to a second embodiment will now be described. The ECU 21 executes modified control processes which will be described hereinlater.

Firstly, a modified ignition control process will be described.

When the ignition control process is started in response to start of the engine, it is first made a judgment on the condition of a second fouling detection flag Eb. The second fouling detection flag Eb is an index indicating whether or not the ignition timing is to be set for elimination or removal of the fouling. The condition of the second fouling detection flag Eb is determined by the modified fouling inhibiting process which will be described later, and the second fouling detection flag Eb is brought into a set condition when it is judged that the spark plug is fouled and the fuel injection timing is not within limits and into a reset condition when the spark plug is judged not fouled.

In this instance, when the second fouling detection flag Eb is in the reset condition, an operating condition of the engine which is detected by an operating condition detecting process which is executed separately, is read, and an ignition timing suited for the operating condition of the engine is calculated on the basis of the read operating condition and by using a map or an expression and determined as an ignition timing for a combustion cycle of this time.

Further, when the second fouling detection flag Eb is in the set condition, the ignition timing is not updated in this ignition control process but the following process is executed by using an ignition timing which is determined by the modified fouling inhibiting process which will be described later.

Except for the above, the ignition control process is substantially the same as that of the embodiment described with reference to FIGS. 1 to 5.

Then, a modified fuel control process for injecting fuel directly into a cylinder at a fuel injection timing will be described.

When the fuel control process is started in response to start of the engine, a judgement on the condition of a fourth fouling detection flag Ed is first made. The fourth fouling detection flag Ed is an index for indicating whether the combustion mode is to be set to a stratified combustion or a homogeneous combustion. The condition of the fourth fouling detection flag Ed is determined by the fouling inhibiting process which will be described later, and the fourth fouling detection flag Ed is brought into a reset condition when the spark plug is judged not fouled and into a set condition when it is judged that the spark plug is fouled and the fuel injection timing, ignition timing and fuel injection timing are not within respective limits.

In this instance, when the fourth fouling detection flag Ed is in the set condition, an operating condition of the engine which is detected by the operating condition detecting process which is executed separately, is read to execute a homogeneous combustion, and a fuel injection timing within the range of the intake stroke and suited for the operating condition of the engine is calculated on the basis of the read operating condition and by using a map or an expression and determined as a fuel supply quantity for a combustion cycle of this time.

When the fourth fouling detection flag Ed is in the reset condition, the condition of a first fouling detection flag Ea is judged. The first fouling detection flag Ea is an index for indicating whether or not the fuel injection timing is to be set for inhibiting the progress of fouling. The condition of the first fouling detecting flag Ea is determined by the fouling inhibiting process which will be described later, and the first fouling detection flag Ea is brought into a set condition when the spark plug is judged fouled and into a reset condition when the spark plug is judged not fouled.

When the fourth fouling detection flag Ed is in the reset condition and the first fouling detection flag Ea is in the reset condition, an operating condition of the engine which is detected by the operating condition detecting process which is executed separately, is read to execute a stratified combustion, and a fuel injection timing within the range of the intake stroke and suited to the operating condition of the engine is calculated on the basis of the read operating condition and by using a map or an expression and determined as a fuel injection timing for a combustion cycle of this time.

Further, when the fourth fouling detection flag Ed is in the reset condition and the first fouling detection flag Ea is in the set condition, the fuel injection timing is not updated in the fuel control process of this time though a stratified combustion is executed, and the following process is executed by using a fuel injection timing which is determined so as to be within the range of the compression stroke by the fouling inhibiting process which will be described later.

In the foregoing steps of the fuel control process, the combustion mode and the fuel injection timing are determined on the basis of the conditions of the first fouling detection flag Ea and the fourth fouling detection flag Ed.

In the subsequent steps of the fuel control process, the conditions of the fourth fouling detection flag Ed and a third fouling detection flag Ec are judged. The third fouling detection flag Ec is an index for indicating whether or not the fuel injection quantity is to be set for inhibiting the progress of fouling. The condition of the third fouling detection flag Ec is determined by the fouling inhibiting process which will be described later, and the third fouling detection flag Ec is brought into a set condition when it is judged that the spark plug is fouled and the fuel injection timing and ignition timing are not within respective limits and into a reset condition when the spark plug is judged not fouled.

In this instance, when the fourth fouling detection flag Ed is in the set condition or when the fourth fouling detection flag Ed is in the reset condition and the third fouling detection flag Ec is in the reset condition, an operating condition of the engine which is detected by the operating condition detecting process which is executed separately, is read, and a fuel injection quantity suited to the operating condition of the engine is calculated on the basis of the read operating condition and by using a map or an expression and determined as a fuel injection timing for a combustion cycle of this time.

Further, when the fourth fouling detection flag Ed is in the reset condition and the third fouling detection flag Ec is in the set condition, the fuel injection quantity is not updated in this fuel control process but the following steps are executed by using a fuel injection quantity which is determined by the modified fouling inhibiting process which will be described later.

In the steps of the fuel control process which are executed from the time the fuel injection timing is determined up to this time, the fuel injection quantity is determined on the basis of the conditions of the third fouling detection flag Ec and the fourth fouling detection flag Ed. Thereafter, when it comes the fuel injection timing which is finally determined by the aforementioned steps, the fuel instruction signal is varied to become high in level and thereby the fuel controller 25 is operated to start injection of fuel into a cylinder of the engine. Then, after lapse of a time necessary for carrying out supply of fuel of the fuel injection quantity which is finally determined (namely, the duration time during which the fuel instruction signal is maintained high in level since the fuel instruction signal is varied to become high in level), the fuel instruction signal is varied to become low in level and thereby the operation of the fuel controller 25 is stopped to stop injection of fuel.

Except for the above, the fuel control process is substantially the same as that of the first embodiment described with reference to FIGS. 1 to 5.

Then, with reference to the flowchart of FIG. 7, a modified fouling detection process for detection of spark plug fouling in a direct fuel injection engine, which is executed by the ECU 21 will be described. In the meantime, the fouling inhibiting process is started after lapse of a predetermined time (e.g., a time necessary for the coolant temperature to rise beyond 50° C.) after start of the engine. Further, the fouling detection flags Ea, Eb, Ec, Ed whose conditions are determined in this fouling inhibiting process are all brought into a reset condition and initialized.

When the fouling inhibiting process is started, it is first read in step S710 a fouling judgement criterion A used for a judgement on whether or not the leak spark frequency F exceeds a range which enables the engine to operate stably, in accordance with the operating condition of the engine and by using a map or an expression the parameters of which are operating conditions of the engine. In the meantime, the map or expression is determined on the basis of the result of measurement which is conducted previously, and the fouling judgement criterion A according to the operating condition of the engine is calculated by using the operating conditions of the engine as parameters.

Then, in step S720, it is judged whether or not the leak spark frequency F of the engine in operation is larger than the fouling judgement criterion A read in step S710. When the judgement is Yes, the program proceeds to step S740. When the judgement is No, the program proceeds to step S730. Namely, in step S720, it is judged on the basis of the leak spark frequency F whether or not the spark plug fouling is in a condition of disabling the engine to operate stably. In other words, it is judged in step S720 whether or not a process for inhibiting the progress of spark plug fouling is to be performed. In the meantime, the leak spark frequency F is calculated by the above described leak spark frequency calculating process and represents the latest leak spark occurrence rate (%) of the engine.

When the judgement in step S720 is No, the program proceeds to step S730. In step S730, the fouling detection flags Ea, Eb, Ec, Ed are all brought into the reset condition. By so setting the fouling detection flags Ea, Eb, Ec, Ed, the combustion mode, ignition timing and fuel injection timing which are suited to the operating condition of the engine at normal driving in which there is not caused any spark plug fouling are determined by the above described ignition control process and the fuel control process. When step S730 is executed, the program returns to step S710.

When the judgement in step S720 is Yes, the program proceeds to step S740. In Step S740, it is judged whether or not the fuel injection timing having been set at this moment is within the limits which are determined so as to enable the engine to operate stably. When the judgement in step S740 is Yes, the program proceeds to step S750. When the judgement in step S740 is No, the program proceeds to step S760. In the meantime, the fuel injection timing at this moment corresponds to the fuel injection timing of the last combustion cycle.

In step S750, the first fouling detection flag Ea is brought into a set condition. By so bringing the first fouling detection flag E into a set condition, the fuel injection timing is not determined by the above described fuel control process but by this fouling inhibiting process.

Further, in step S750, the fuel injection timing is varied by a constant amount for the purpose of inhibiting the progress of spark plug fouling. In this instance, for varying the fuel injection timing by a constant amount, it is desirable that the fuel injection timing is advanced. Namely, by advancing the fuel injection timing, it becomes possible to obtain a sufficient time necessary for the supplied fuel to be stirred within the cylinder at the compression stroke and thereby combust the fuel completely, thus making it possible to inhibit fuel in a liquid state from producing carbon.

Further, the fuel injection timing can be varied by calculating an indicated mean effective pressure every each combustion cycle, calculating a variation of the indicated mean effective pressure caused by advancing the fuel injection timing by a constant amount and varying the fuel injection timing in a way as to cause the indicated mean effective pressure to become larger. Namely, for example, in case the indicated mean effective pressure in the combustion cycle after the fuel injection timing is advanced becomes larger than that before the fuel injection timing is advanced, the fuel injection timing in the next combustion cycle is further advanced. On the contrary, in case the indicated mean effective pressure in the combustion cycle after the fuel injection timing is advanced becomes smaller than that before the fuel injection timing is advanced, the fuel injection timing in the next combustion cycle is retarded.

In case the fuel injection timing is actually varied by using the indicated mean effective pressure, the indicated mean effective pressures in the last combustion cycle is compared with that in the combustion cycle before the last. When the indicated mean effective pressure in the last combustion cycle is larger than that in the combustion cycle before the last, the fuel injection timing which is attained by varying the fuel injection timing in the last combustion cycle in the direction in which the fuel injection timing is varied from the last combustion cycle to the combustion cycle before the last is determined as the fuel injection timing at this time. On the contrary, when the indicated mean effective pressure in the last combustion cycle is smaller than that in the combustion cycle before the last, the fuel injection timing which is attained by varying the fuel injection timing in the last combustion cycle in the direction opposite to that in which the fuel injection timing is varied from the combustion cycle before the last to the last combustion cycle is determined as the fuel injection timing at this time.

Control of the fuel injection timing so as to increase the indicated mean effective pressure in the above described manner improves the combustion condition of the mixture, and therefore it becomes possible to combust fuel completely and inhibit production of carbon. Thus, by varying the fuel injection timing for thereby combusting fuel completely, the progress of spark plug fouling can be inhibited and the carbon adhered to the surface of the insulator will be soon burnt off by the self-cleaning action of the spark plug.

When step S750 is finished, the program returns to step S710. In step S760, it is judged whether or not the ignition timing having been set at this moment is within the limits which are determined so as to enable the engine to operate stably. When the judgement is Yes, the program proceeds to step S770. When the judgement is No, the program proceeds to step S780. In the meantime, the ignition timing at this moment corresponds to that in the last combustion cycle.

In step S770, the second fouling detection flag Eb is brought into the set condition. By bringing the second fouling detection flag Eb into the set condition, the ignition timing is determined not by the aforementioned ignition control process but by this fouling inhibiting process.

Further, in step S770, the ignition timing is varied by a constant amount so that the progress of spark plug fouling is inhibited. In this instance, for varying the ignition timing by a constant amount, it is desirable that, for example, the ignition timing is advanced. Namely, by advancing the ignition timing, it becomes possible to obtain a sufficient time necessary for the supplied fuel to be stirred within the cylinder at the compression stroke and thereby combust the fuel completely, thus making it possible to inhibit fuel in a liquid state from producing carbon.

The ignition timing can also be varied by calculating an indicated mean effective pressure every each combustion cycle, calculating a variation of the indicated mean effective pressure caused by advancing the ignition timing by a constant amount and varying the ignition timing in a way as to cause the indicated mean effective pressure to become larger. Namely, for example, in case the indicated mean effective pressure in the combustion cycle after the ignition timing is advanced becomes larger than that before the ignition timing is advanced, the ignition timing in the next combustion cycle is further advanced. On the contrary, in case the indicated mean effective pressure in the combustion cycle after the ignition timing is advanced becomes smaller than that before the ignition timing is advanced, the ignition timing in the next combustion cycle is retarded.

In case the ignition timing is actually varied by using the indicated mean effective pressure, the indicated mean effective pressures in the last combustion cycle is compared with that in the combustion cycle before the last. When the indicated mean effective pressure in the last combustion cycle is larger than that in the combustion cycle before the last, the ignition timing which is attained by varying the ignition timing in the last combustion cycle in the direction in which the ignition timing is varied from the last combustion cycle to the combustion cycle before the last is determined as the ignition timing at this time. On the contrary, when the indicated mean effective pressure in the last combustion cycle is smaller than that in the combustion cycle before the last, the ignition timing which is attained by varying the ignition timing in the last combustion cycle in the direction opposite to that in which the ignition timing is varied from the combustion cycle before the last to the last combustion cycle is determined as the ignition timing at this time.

Control of the ignition timing so as to increase the indicated mean effective pressure in the above described manner improves the combustion condition of the mixture, and therefore it becomes possible to combust fuel completely and inhibit production of carbon. Thus, by varying the ignition timing for thereby combusting fuel completely, the progress of spark plug fouling can be inhibited and the carbon adhered to the surface of the insulator will be soon burnt off by the self-cleaning action of the spark plug.

When step 770 is finished, the program returns to step S710.

In step S780, it is judged whether or not the fuel injection quantity having been set at this moment is within the limits which are determined so as to enable the engine to operate stably. When the judgement in step S780 is Yes, the program proceeds to step S790. When the judgement in step S780 is No, the program proceeds to step S800. In the meantime, the fuel injection quantity at this moment corresponds to that in the last combustion cycle.

In step S790, the third fouling detection flag Ec is brought into the set condition. By bringing the third fouling detection flag Ec into the set condition, the fuel injection quantity is not determined by the above described fuel control process but by this fouling inhibiting process.

Further, in step S790, the fuel injection quantity is varied by a constant amount so as to inhibit the progress of spark plug fouling. In this instance, for varying the fuel injection quantity, it is desirable, for example, to decrease the fuel injection quantity. Namely, by decreasing the fuel injection quantity and thereby making higher the air-fuel ratio of the mixture adjacent the electrodes of the spark plug (i.e., making the mixture leaner), an excess of fuel in a liquid state can be reduced, thus making it possible to inhibit production of carbon resulting from the fuel in a liquid state. Further, by decreasing the fuel injection quantity, it becomes possible to inhibit the progress of spark plug fouling and then make the carbon adhered to the surface of the insulator be burnt off soon by the self-cleaning action of the spark plug for thereby cleaning the spark plug.

When the step S790 is finished, the program returns to step S710.

In step S800, the fourth fouling detection flag Ed is brought into the set condition. By bringing the fourth fouling detection flag Ed into the set condition, the combustion mode which is determined by the aforementioned fuel control process is varied from the stratified combustion to the homogeneous combustion.

By changing the combustion mode from the stratified combustion to the homogeneous combustion, fuel can be stirred sufficiently within the cylinder to accelerate its atomization, thus making it possible to inhibit production of carbon resulting from fuel in a liquid state.

When the step S800 is executed, the fouling inhibiting process is finished.

As having been described as above, in the modified fouling inhibiting process, when it is judged that there is not any fouling (i.e., when the judgement in step S720 is No), all the fouling detection flags are reset (S730) for making the combustion mode, ignition timing and fuel injection timing be respectively determined by the ignition control process and the fuel control process on the basis of the operating condition of the engine.

For this reason, when it is judged that there is not any fouling, the engine can be operated on the combustion mode, ignition timing, fuel injection timing and fuel injection quantity (air-fuel ratio) which are suited to the operating condition of the engine at normal driving.

Further, when it is judged that there is some fouling (i.e., when the judgement in step S720 is Yes), the first fouling detection flag Ea is brought into the set condition (S750) for making the fuel injection timing be determined not by the fuel control process but by this fouling inhibiting process. In this fouling inhibiting process, the fuel injection timing which is determined last in the fuel control process (i.e., the fuel injection timing which is determined immediately before it is judged that there is some fouling) is determined as an initial value and is varied by a constant amount so as to inhibit the progress of fouling. Further, once the fouling is detected, the judgement in step S720 is kept Yes until the fouling is eliminated or removed. Thus, once update of the fuel injection timing by the fouling inhibiting process is started, the fuel injection timing keeps varying a constant amount repeatedly until it is judged that there is no fouling. For this reason, by variations or control of the fuel injection timing, the operating condition of the engine is brought into a condition of allowing the spark plug to exhibit the self-cleaning action more efficiently, thus making it possible to inhibit the progress of fouling and eliminate the fouling effectively.

However, if the fuel injection timing is varied unlimitedly, there is caused a possibility that the engine cannot operate stably. Thus, after it is judged in step S740 whether or not the fuel injection timing is within the limits that enable the engine to operate properly, the fuel injection timing is varied by a constant amount.

When the fuel injection timing becomes outside the limits due to repeated variations thereof, the second fouling detection flag Eb is brought into the set condition (S770) so that the ignition timing is determined not by the ignition control process but by the fouling inhibiting process.

In this fouling inhibiting process, the ignition timing which is determined last in the ignition control process is determined as an initial value and is varied by a constant amount so as to inhibit the progress of fouling. Further, once the fouling is detected, the judgement in step S720 is kept Yes until the fouling is eliminated or removed. Thus, once update of the ignition timing by the fouling inhibiting process is started, the ignition timing keeps varying a constant amount repeatedly until it is judged that there is no fouling. For this reason, by variations or control of the ignition timing, the operating condition of the engine is brought into a condition of allowing the spark plug to exhibit the self-cleaning action more efficiently, thus making it possible to inhibit the progress of fouling and eliminate or remove the fouling effectively.

However, if the ignition timing is varied unlimitedly, there is caused a possibility that the engine cannot operate stably due to occurrence of knocking, etc. Thus, after it is judged in step S760 whether or not the ignition timing is within the limits that enable the engine to operate stably, the ignition timing is varied by a constant amount.

When the ignition timing becomes outside the limits due to repeated variations thereof, the third fouling detection flag Ec is brought into the set condition (S790) so that the fuel injection quantity is determined not by the fuel control process but by the fouling inhibiting process.

In this fouling inhibiting process, the fuel injection quantity which was determined last in the fuel control process is determined as an initial value and is varied by a constant amount so as to inhibit the progress of fouling. Further, once the fouling is detected, the judgement in step S720 is kept Yes until the fouling is eliminated or removed. Thus, once update of the fuel injection quantity by the fouling inhibiting process is started, a variation of the fuel injection quantity by a constant amount is repeated until it is judged that there is no fouling. For this reason, by variations or control of the fuel injection quantity, the engine is brought into an operating condition where the spark plug can exhibit its self-cleaning action more efficiently, thus making it possible to inhibit the progress of fouling and eliminate or remove the fouling effectively.

However, if the fuel injection quantity is varied unlimitedly, there is caused a possibility that the engine cannot operate stably due to occurrence of a misfire, etc. Thus, after it is judged in step S780 whether or not the fuel injection quantity is within the limits that enable the engine to operate properly, the fuel injection quantity is varied by a constant amount.

When the fuel injection quantity becomes outside the limits due to the repeated variations thereof, the fourth fouling detection flag Ed is brought into the set condition (S800) so that the combustion mode of the mixture which is determined by the aforementioned fuel control process is varied from the stratified combustion to the homogeneous combustion. Then, the fouling inhibiting process is finished.

Further, when it is judged that there is no fouling (i.e., judgement in step S720 is No) during update of the fuel injection timing, ignition timing and fuel injection quantity, which is carried out by the fouling inhibiting process (during execution of steps from S740 to S780) in response to a judgement that there is some fouling (i.e., affirmative judgement in step S720), all the fouling detection flags Ea, Eb, Ec, Ed are brought into the reset condition (S730). By this, the combustion mode, ignition timing, fuel injection timing and fuel injection quantity are respectively determined by the ignition control process and the fuel control process so as to exercise control suited to the operating condition of the engine at normal driving.

Then, before the end of the fouling inhibiting process, the fourth fouling detection flag Ed is brought into the set condition so as to vary the combustion mode from the stratified combustion to the homogeneous combustion. Thus, after the end of the fouling inhibiting process, the fuel control process controls the operation of the engine after changing the combustion modes from the stratified combustion to the homogeneous combustion, fuel can be stirred sufficiently within the cylinder to accelerate its atomization and therefore can be combusted completely, thus making it possible to inhibit production of carbon resulting from fuel in a liquid state. When the fouling is eliminated or removed by operating the engine on the homogeneous combustion, the fourth fouling detection flag Ed is brought into the reset condition by a combustion mode alteration process which is executed separately in the ECU 21, thus causing the combustion mode to be varied to the stratified combustion again. In response to this, the fouling inhibiting process is started again.

As having been described above, in the control system 1 adapted for use in a direct fuel injection engine, a spark plug fouling is detected on the basis of discharge current before it causes a misfire. When a spark plug fouling is detected, the engine is control ed to vary the combustion mode, ignition timing, fuel injection timing and fuel injection quantity so as to inhibit the progress of the fouling.

Further, in the modified fouling inhibiting process, the control led variables of the engine which are varied in one combustion cycle are in the order of the injection timing, ignition timing and fuel injection quantity. However, this is not for the purpose of limitation but can be, for example, varied to such an order in which the ignition timing is varied first and subsequently the fuel injection timing and the fuel injection quantity are varied in this order. Further, in an internal combustion engine wherein the progress of fouling can be inhibited by varying only one kind of controlled variable, the control system 1 can be constructed so as to vary only one kind of controlled variable.

Except for the above, the control system 1 of this embodiment is substantially similar to the first embodiment described with reference FIGS. 1 to 5 and can produce substantially the same effect.

Figure 7:
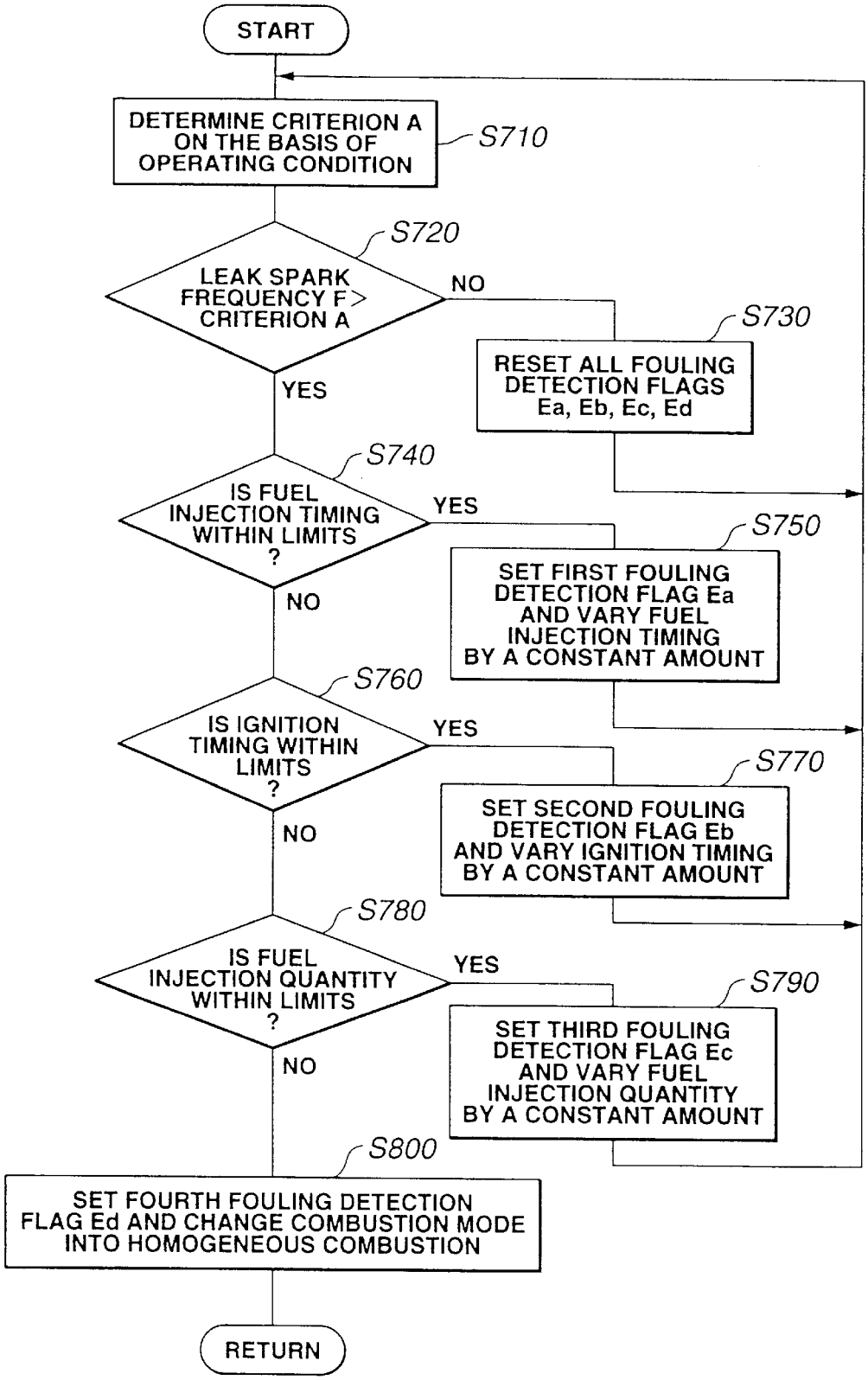
FIG. 7 is a flow chart of a fouling inhibiting process according to a second embodiment of the present invention, which is executed in the ECU 21 in the control system of FIG. 1.
Figure 8:
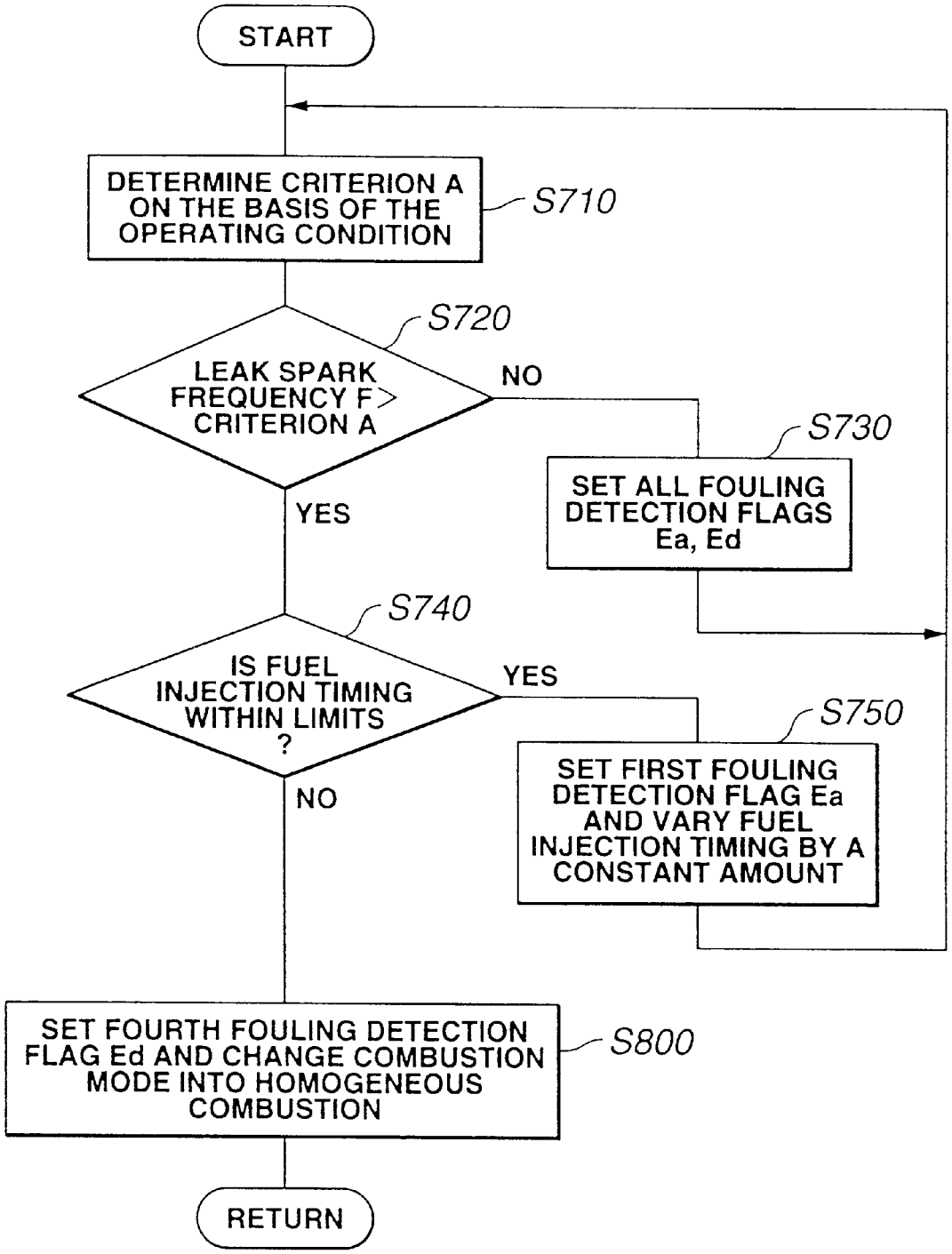
FIG. 8 is a flow chart of a fouling inhibiting process according to a third embodiment of the present invention, which is executed in the ECU 21 of the control system of FIG. 1.

FIG. 8 shows a fouling inhibiting process for the control system 1 for a direct fuel injection engine according to a third embodiment of the present invention. In this embodiment, the control system 1 is adapted to vary the fuel injection timing and the combustion mode when a spark plug fouling is detected. In the meantime, in the control system 1 of this modification, the ignition control process updates the fuel injection quantity at all times irrespective of the condition of the second fouling detection flag Eb, and the fuel control process updates the fuel injection quantity at all times irrespective of the condition of the third fouling detection flag Ec. The control system 1 of this embodiment is substantially similar to the previous embodiment described with reference to FIG. 7 except for the fouling inhibiting process, ignition control process and fuel control process.

In the fouling inhibiting process shown in FIG. 8, the steps from S760 to S790 in the fouling inhibiting process shown in FIG. 7 are omitted. When the judgement in step S740 is No, the program proceeds to step S800. Further, step S730 in this embodiment differs from that in the embodiment of FIG. 7 in that not four but two fouling detection flags Ea, Ed are brought into the reset condition. The control executed in each step of this embodiment is substantially similar to a corresponding step in the embodiment of FIG. 7 except for step S730.

In this manner, by decreasing the controlled variables which are to be varied upon detection of fouling, the control system 1 of this embodiment can simplify the control to be executed by the ECU 21 as compared with that of the previous embodiment described with reference to FIG. 7.

Further, while in this embodiment the controlled variables which are to be varied within the same combustion cycle upon detection of fouling are the ignition timing, fuel injection timing and fuel injection quantity and varied one by one in sequence, a plurality of controlled variables can be varied at the same time within the same combustion cycle. For example, the ignition timing and the fuel injection timing are varied within the same combustion cycle so as to inhibit the progress of fouling. By so varying the controlled variables, the progress of fouling can be inhibited more efficiently.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A control system for an internal combustion engine comprising:

a control unit;

a fuel control device for controlling supply of an air-fuel mixture to the engine in response to a signal from the control unit; and an ignition control device for controlling generation of a spark for igniting the air-fuel mixture in response to a signal from the control unit;

the control unit including:

a detecting section for detecting a discharge current flowing between electrodes of a spark plug when a high voltage for ignition is applied to the spark plug;

a judging section for judging whether or not the spark plug is fouled on the basis of the discharge current; and an inhibiting section for inhibiting the progress of spark plug fouling when the spark plug is judged fouled.

2. A control system according to claim 1, wherein the inhibiting section varies at least an ignition timing of the spark plug when the spark plug is judged fouled.

3. A control system according to claim 1, wherein the inhibiting section varies at least a quantity of fuel supplied to the engine when the spark plug is judged fouled.

4. A control system according to claim 1, wherein the judging section integrates the discharge current flowing between the electrodes of the spark plug during a period of the spark of the spark plug, and judges whether or not the spark plug is fouled on the basis of a comparison between an integration value of the discharge current and a discharge current criterion.

5. A control system according to claim 1, wherein the judging section calculates a current detection time during which the discharge current during a period of the spark of the spark plug is equal to or larger than a detection time criterion, and judges whether or not the spark plug is fouled on the basis of a comparison between the current detection time and the detection time criterion.

6. A control system for an internal combustion engine comprising:

detecting means for detecting a discharge current flowing between electrodes of a spark plug when a high voltage for ignition is applied to the spark plug;

judging means for judging whether or not the spark plug is fouled on the basis of the discharge current; and inhibiting means for inhibiting the progress of spark plug fouling when the spark plug is judged fouled.

7. A control system according to claim 6, wherein the inhibiting means varies at least an ignition timing of the spark plug when the spark plug is judged fouled.

8. A control system according to claim 6, wherein the inhibiting means varies at least a quantity of fuel supplied to the engine when the spark plug is judged fouled.

9. A control system according to claim 6, wherein the judging means integrates the discharge current flowing between the electrodes of the spark plug during a period of spark discharge of the spark plug, and judges whether or not the spark plug is fouled on the basis of a comparison between an integration value of the discharge current and an integration criterion.

10. A control system according to claim 6, wherein the judging means calculates a current detection time during which the discharge current during a period of a spark of the spark plug is equal to or larger than a detection time criterion, and judges whether or not the spark plug is fouled on the basis of a comparison between the current detection time and the detection time criterion.

11. A control system for a direct fuel injection internal combustion engine comprising:

a control unit;

a fuel control device for controlling injection of fuel into a cylinder of the engine in response to a signal from the control unit; and an ignition control device for controlling generation of a spark for igniting the fuel in the cylinder in response to a signal from the control unit;

the control unit including:

a detecting section for detecting a discharge current flowing between electrodes of a spark plug provided to the cylinder when a high voltage for ignition is applied to the spark plug;

a judging section for judging whether or not the spark plug is fouled on the basis of the discharge current; and a inhibiting section for varying at least a fuel injection timing at which the fuel is injected into the cylinder and thereby inhibiting the progress of fouling of the spark plug when the spark plug is judged fouled.

12. A control system according to claim 11, wherein the inhibiting section varies an ignition timing of the spark plug when the spark plug is judged fouled.

13. A control system according to claim 11, wherein the inhibiting section varies a combustion mode of the engine from a stratified combustion to a homogeneous combustion.

14. A control system according to claim 11, wherein the inhibiting section varies a quantity of fuel injected into the cylinder when the spark plug is judged fouled.

15. A control system according to claim 11, wherein the judging section integrates the discharge current flowing between the electrodes of the spark plug during a period of a spark of the spark plug, and judges whether or not the spark plug is fouled on the basis of a comparison between an integration value of the discharge current and a discharge current criterion.

16. A control system according to claim 11, wherein the judging section calculates a current detection time during which the discharge current during a period of a spark of the spark plug is equal to or larger than a detection time criterion, and judges whether or not the spark plug is fouled on the basis of a comparison between the current detection time and the detection time criterion.

17. A control system for a direct fuel injection internal combustion engine comprising:

detecting means for detecting a discharge current flowing between electrodes of a spark plug when a high voltage for ignition is applied to the spark plug;

judging means for judging whether or not the spark plug is fouled on the basis of the discharge current; and inhibiting means for varying at least a fuel injection timing at which fuel is injected into a cylinder and thereby inhibiting the progress of fouling of the spark plug when the spark plug is judged fouled.

18. A control system according to claim 17, wherein the inhibiting means varies an ignition timing of the spark plug when the spark plug is judged fouled.

19. A control system according to claim 17, wherein the inhibiting means varies a combustion mode of the engine from a stratified combustion to a homogeneous combustion.

20. A control system according to claim 17, wherein the inhibiting means varies a quantity of fuel injected into the cylinder when the spark plug is judged fouled.

21. A control system according to claim 17, wherein the judging means integrates the discharge current flowing between the electrodes of the spark plug during a period of a spark of the spark plug, and judges whether or not the spark plug is fouled on the basis of a comparison between an integration value of the discharge current and an integration criterion.

22. A control system according to claim 17, wherein the judging means calculates a current detection time during which the discharge current during a period of a spark of the spark plug is equal to or larger than a detection time criterion, and judges whether or not the spark plug is fouled on the basis of a comparison between the current detection time and the detection time criterion.

23. A method of controlling an internal combustion engine comprising:

detecting a discharge current flowing between electrodes of a spark plug when a high voltage for ignition is applied to the spark plug;

judging whether or not the spark plug is fouled on the basis of the discharge current; and inhibiting the progress of fouling of the spark plug when the spark plug is judged fouled.

24. A method according to claim 23, wherein the inhibiting comprises varying at least an ignition timing of the spark plug when the spark plug is judged fouled.

25. A control system according to claim 23, wherein the inhibiting comprises varying at least a quantity of fuel supplied to the engine when the spark plug is judged fouled.

26. A control system according to claim 23, wherein the judging comprises integrating the discharge current flowing between the electrodes of the spark plug during a period of a spark of the spark plug, and means for judging whether or not the spark plug is fouled on the basis of a comparison between an integration value of the discharge current and a discharge current criterion.

27. A method according to claim 23, wherein the judging comprises calculating a current detection time during which the discharge current during a period of a spark of the spark plug is equal to or larger than a detection time criterion, and judging whether or not the spark plug is fouled on the basis of a between the current detection time and the detection time criterion.

28. A method according to claim 23, wherein the engine is of the direct fuel injection type.

29. A method according to claim 28, wherein the inhibiting comprises varying at least a fuel injection timing at which fuel is injected into a cylinder and thereby inhibiting the progress of fouling of the spark plug when the spark plug is judged fouled.

30. A method according to claim 29, wherein the inhibiting comprises varying a combustion mode of the engine from a stratified combustion to a homogeneous combustion.

31. A method according to claim 29, wherein the inhibiting comprises varying a quantity of fuel injected into the cylinder when the spark plug is judged fouled.

* * * * *